US005205922A

United States Patent [19]

Ahearn, Jr. et al.

[11] Patent Number: 5,205,922

[45] Date of Patent: Apr. 27, 1993

[54] FORMATION OF PITTING RESISTANT ANODIZED FILMS ON ALUMINUM

[75] Inventors: John S. Ahearn, Jr., Sykesville; Guy D. Davis, Columbia, both of Md.; William C. Moshier, Englewood, Colo.

[73] Assignee: The United States of America as represented by the Secretary of the Navy, Washington, D.C.

[21] Appl. No.: 618,190

[22] Filed: Nov. 20, 1990

[51] Int. Cl.[5] ..... C25D 11/06

[52] U.S. Cl. ..... 205/332

[58] Field of Search ..... 205/332

[56] References Cited

FOREIGN PATENT DOCUMENTS 2-163390 6/1990 Japan .

*Primary Examiner*—T. M. Tufariello

*Attorney, Agent, or Firm*—James T. Busch; Thomas E. McDonald; A. F. Kwitnieski

[57] ABSTRACT

A method and apparatus for retarding the pitting of aluminum by coating the aluminum with a film which includes molybdenium oxide.

The aluminum material is preexposed to a molybdate solution before anadizing in a sodium tartrate solution.

7 Claims, 2 Drawing Sheets

FORMATION OF PITTING RESISTANT ANODIZED FILMS ON ALUMINUM

BACKGROUND OF INVENTION

This invention relates to a method of preparing aluminum so as to resist pitting. Generally, aluminum is protected by an oxide film that forms on its surface and restricts the access of the environment to the metal. The thickness of the oxide can be varied by anodizing the material, which involves polarizing the metal electropositively in an electrolyte. Pitting is a localized corrosion process on aluminum that can occur in chloride-containing environments. There is no effective way of improving the resistance of aluminum to pitting without adding inhibitors to the solution to which the metal is exposed. Although anodizing does result in increasing the time required to initiate a pit, the thermodynamic propensity of a pit to form does not change.

SUMMARY OF THE INVENTION

The present invention relates to a method of reducing the pitting propensity of aluminum by pre-exposing the aluminum to a molybdate solution during the anodizing process, thereby directly incorporating the inhibitor compound into the anodized film. This would be particularly important for structures exposed to marine environments where the solution chemistry cannot be easily controlled.

DESCRIPTION OF PREFERRED EMBODIMENT

Figure 1:
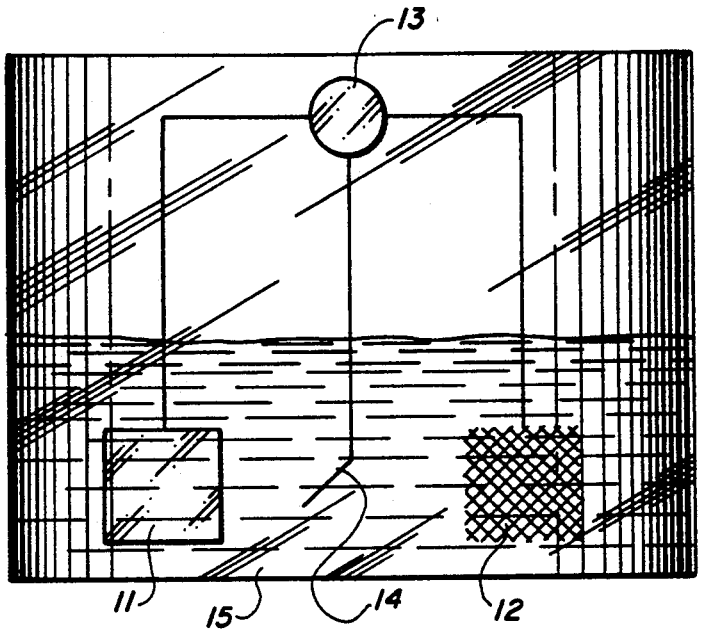
FIG. 1 depicts the anodic polarization of aluminum samples in solution.
Figure 2:
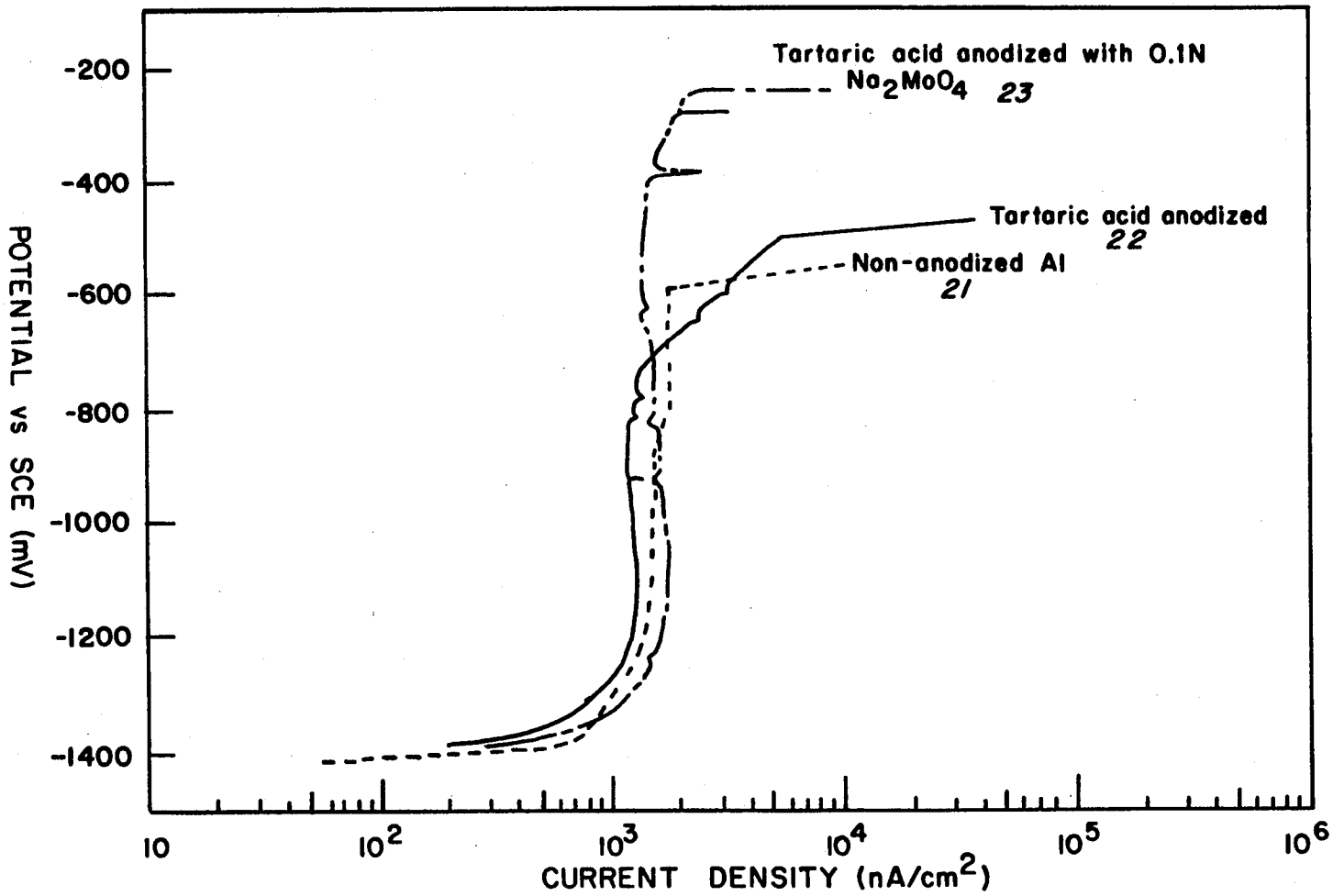
FIG. 2 shows the potentiodynamic response of the non-anodized aluminum and two anodized aluminums during polarization.

Referring now to the drawings, FIG. 1 shows apparatus used for conducting tests to determine whether inhibitors could be incorporated into anodized films to provide pitting protection. In FIG. 1, aluminum test sample 11 with a thin ($\approx$20A thick) passive film on its surface, is connected to anode mesh 12 via potentiostat 13. Potentiostat 13 and reference electrode 14 are used to set the polarization rate at 0.1mv/s. Solution 15 is 0.05 M $NaSO_4$ containing 1000 pp $Cl-$. The response of non-anodized aluminum under these test conditions is shown by the dashed line 21 in FIG. 2.

Figure 3:
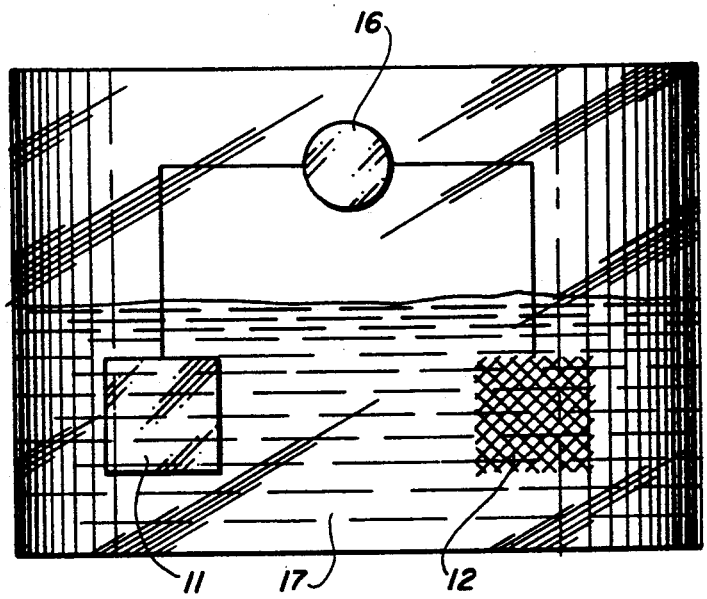
FIG. 3 shows the anodization apparatus used for surface preparation of the aluminum of the invention.

FIG. 3 depicts apparatus for anodizing aluminum. Aluminum sample 11 is connected to anode mesh 12 via galvanostat 16. Galvanostat 16 is set to provide an anodizing rate of 10 mA/cm$^2$. Solution 17 in a first test consisted of 0.2 M sodium tartrate. Aluminum sample 11 was anodized in this sodium tartrate solution at 10 mA/cm$^2$ for 30 min, removed from the anodizing solution, rinsed with high purity water, and dried. This anodization treatment is known to produce a uniform oxide on the surface of aluminum. The sample was then placed into the same solution used to test for pitting, as in FIG. 1, and allowed to come to equilibrium prior to polarization. The sample was polarized anodically up to the pitting potential, $-500$ mV (SCE) as shown by the solid line 22 of FIG. 2. Although this potential was slightly higher than that of the non-anodized aluminum, the change was not substantial enough to result in pitting protection in marine environments, and was probably due to the increased incubation time needed for the pit to penetrate thick oxide.

The apparatus of FIG. 3 was again used to anodize an aluminum sample 11. In this second test the solution 17 consisted of 0.2 M sodium tartrate with the addition of a sodium molybdate inhibitor 0.2 M $Na_2MoO_4$. Anodization proceeded for 32 minutes and the sample was again rinsed and dried before being tested in the apparatus of FIG. 1.

The sample was allowed to come to equilibrium prior to anodically polarizing the anodized aluminum. The pitting potential was found to be close to $-320$ mV (SCE) as seen by the dotted line 23 of FIG. 2. This represents a substantial shift in the pitting potential, well above the corrosion potential of aluminum in aerated chloride-containing neutral solutions [$-515$ mV(SCE)].

In this instance when the aluminum was pre-exposed to the molybdate solution, the inhibiting effect of the compound was found to be retained by the surface film even though the film behaved as a passive film on aluminum, with a corrosion potential similar to pure aluminum. This suggests that the inhibitor compound can be directly incorporated into the anodized film to provide protection against attack in environments containing chlorides without the inhibitor molecule being present in the aggressive solution.

Many modifications to the above described embodiment of the invention may be made without departing from the scope thereof. For instance, nitrates could be used in place of molybdates as inhibitors. Also, although the process is described for pure aluminum, it is believed that it would work on aluminum alloys. Further, polarization can be either anodic or cathodic. The only requirement is that the anodizing solution must be one such that the inhibitor compound will remain chemically stable. In the case of molybdates, this requires that the pH of the solution be at least 2.

What is claimed is:

1. A method of protecting aluminum from pitting, comprising the steps of:

(a) growing an oxide film on aluminum and (b) incorporating a molybdenum inhibitor into said film by anodizing the aluminum in the presence of a molybdate inhibitor in solution.

2. A method of protecting aluminum from pitting, comprising the steps of: obtaining a solution of sodium tartrate and sodium molybdate with a pH greater than 2, and anodizing said aluminum in said solution.

3. The method of claim 2 in which said solution is comprised of 0.2 M sodium tartrate and 0.2 M $NaMoO_4$ with a pH of 7.

4. The method of claim 3 in which said solution is anodized at approximately 10A/cM$^2$ for more than 2 minutes.

5. The method of claim 3 in which said solution is anodized at 10 mA/cm$^2$ for 32 minutes.

6. A method of protecting aluminum form pitting, comprising the steps of:

(a) growing an oxide film on aluminum and (b) incorporating an inhibitor into said film by anodizing the aluminum in the presence of a sodium molybdate inhibitor in a solution of sodium tartate which solution has a pH of at least 2.

7. The method of claim 6 in which the solium molybdate inhibitor is anodized at approximately 10 mA/cm$^2$ for approximately 30 min.

* * * * *